US005343887A

United States Patent [19]

Danaher

[11] Patent Number: 5,343,887

[45] Date of Patent: Sep. 6, 1994

[54] SELF-ERECTING PORTABLE FABRIC STRUCTURE

[76] Inventor: Thomas C. Danaher, 484 W. 43rd St., Apt. No. 42-S, New York, N.Y. 10036

[21] Appl. No.: 2,588

[22] Filed: Jan. 11, 1993

[51] Int. Cl.[5] ..... E04H 15/40

[52] U.S. Cl. ..... 135/104; 135/105; 135/109

[58] Field of Search ..... 135/102–108, 135/114, 109, 905

[56] References Cited

U.S. PATENT DOCUMENTS

| | | | |
|---|---|---|---|
| 3,665,944 | 5/1972 | Knapp | 135/106 |
| 3,848,615 | 11/1974 | Warner et al. | 135/4 |
| 3,960,161 | 6/1976 | Norman . | |
| 3,970,096 | 7/1976 | Nicolai | 135/14 |
| 3,990,463 | 11/1976 | Norman . | |
| 4,569,362 | 2/1986 | Fidler, Jr. | 135/104 |
| 4,682,436 | 7/1987 | Ritson . | |
| 4,815,784 | 3/1989 | Zheng . | |
| 4,825,578 | 5/1989 | Robinson | 135/106 X |
| 4,846,205 | 7/1989 | Knoll | 135/114 X |
| 4,979,531 | 12/1990 | Toor et al. | 135/114 X |
| 5,029,847 | 7/1991 | Ross | 135/114 X |
| 5,031,652 | 7/1991 | Lester | 135/104 |
| 5,137,044 | 8/1992 | Brady | 135/104 |

OTHER PUBLICATIONS

Pop-Tent, Inc. (Copy of Advertisement).

CAMPMOR-Mid-Summer 1989, pp. 7, 8, 9.

*Primary Examiner*—Carl D. Friedman

*Assistant Examiner*—Lan C. Mai

*Attorney, Agent, or Firm*—Barnes, Kisselle, Raisch, Choate, Whittemore & Hubert

[57] ABSTRACT

An elongated portable structure for the use as a tent or the like, having an end panel at each end. Each end panel comprises an annular hoop of flexible, resilient, strip material which can be reduced to a much smaller dimension by twisting. A sheet of substantially non-stretchable, flexible fabric in the space within each hoop is secured to the hoop so that the sheet is maintained taut and will resist collapse or distortion of the hoop. The end panels are maintained in generally upright position by at least one spreader rod extending between the end panels, and struts connected to the ends of the rod and attached to the respective end panels. A rigid force distributor may be attached to each strut to engage the sheet within each hoop. A flexible fabric cover with an opening extends between the end panels to provide shelter for a person or persons occupying the structure.

38 Claims, 11 Drawing Sheets

SELF-ERECTING PORTABLE FABRIC STRUCTURE

This invention relates to structures particularly but not exclusively to portable, free-standing structures suitable for shelters such as tents and emergency protection. Specifically, the invention sets new standards of convenience, comfort, reliability and lightness in fabric-tensioned structures. The particular structure described is of a size and weight such that it may be packed and erected by a single user to provide remote shelter. Another embodiment is of a size such that it may be adapted to provide protection feasibly as a quonset-type building and all interim sizes.

BACKGROUND AND SUMMARY OF THE INVENTION

Prior-art structures such as tents utilize some sort of a weight-bearing pole structure which, when assembled, forms a skeleton upon which the fabric covering is suspended. Most tents use bowed poles which place the cover under tension; the tension is usually provided by bending the support poles while suspending the tent from some type of an upstanding fabric sleeve or the like through which the poles are passed. Portable structures such as tents have existed for centuries and have always presented problems of various types.

One of the principal problems with portable structures is that associated with erecting them. In particular, the final set-up shape is completely unrecognizable when the components are laid out and the user must be familiar with an exacting set-up procedure. Segments of often different-length poles are connected and the longest passed through a specific sequence of fabric sleeves. The sleeves and tent cover form a confusing labyrinth and choosing the correct pole for the correct sleeve makes this an unforgiving process. The user also combats the tension of each pole during this process which becomes more difficult as more poles are added. After the last pole is passed through the fabric sleeves, all the poles are secured at both ends with either grommets and/or tie lines. The user must then manipulate this cumbersome bundle and secure it into its erected shape: it is only at this final step the structure becomes recognizable. And to complicate matters, the design of each tent is different from one structure to another so each must be learned separately.

Furthermore, if any one of the components are lost, torn, broken or misplaced, set-up of the structure could be impossible.

Ease of assembly becomes crucial in inclement or severe environments. In short, it is vital to be able to assemble a tent in the shortest possible time and with greatest ease. A user quite frequently cannot remove his mittens or gloves for prolonged periods for fear of cold, therefore a tent which cannot be assembled rapidly and preferably with the hands still encased in protective clothing is a significant liability. Attempts have been made to simplify the task of erecting portable structures. As exemplified by the "wedge" or "dome" tents, these attempts have resulted in impractical or still more complex structures:

Wedge structures rest on a generally rectangular base and are triangular with a connecting pole at the apex. This structure severely limits space near the user's head (headroom).

Dome structures provide increased headroom but waste floor space because they rest on unconventionally-shaped floors. Neither structure fits the user's sleeping bag(s) which are generally rectangular: hexagonal models create unusable sharp corners and square versions are far too wide. Further, both of these structures have apexes which are raised to ensure headroom throughout the tent's length. This compensation creates unused space through much of the central portion of the roof while creating a larger target for wind.

Attempts to simplify the task of erecting portable structures have also resulted in more expensive and heavier structures. Dome tents require added fabric: in addition to providing material for unusable floor and roof areas, the fabric must be cut to fit irregularly-shaped patterns resulting from overlapping support poles. Tenting material is wasted and extra workmanship to cut and sew numerous, irregular patterns raises costs. Further, dome structures require added support poles which are heavier than needed in-use to endure stresses of set-up and are therefore generally the costliest component of portable structures.

In most prior-art tents, the user is restricted from leaning against the assembled structure. The structural integrity of these tents is threatened by stressing a wall or pole by forcing them in a direction not designed to be tensioned. Under good conditions, the result may be a collapsed tent, however torn fabric walls and/or broken support poles may result in a ruined tent.

Some tents require the user to anchor the floor structure to the terrain through the use of stakes or the like during the assembly process. Stakes, or guy lines running to outlying stakes, suffer the obvious disadvantage of coming loose either by the tent working in the wind or by the user tripping over them during darkness. Such structures are often unsuitable for rocky or sandy terrain. Further, the orientation of these structures cannot be rapidly changed under varying weather conditions since the support element of the tent is violated when the anchoring devices are removed from the terrain.

Lastly, the poles in prior-art structures limit compactability of the tent. The span of the longest pole determines the packed length; attempts to shorten pole segments increases costs and set-up difficulties. 20 to 30-inch packed sizes are common despite backpack carrying frames being 14 to 15-inches wide. Therefore, the ends of the packed tent protrude to snag trees and bush during transport. Further, most structures pack into dense cylinders which are typically cumbersome and inconvenient to balance during transport.

Self-contained tension structures which eliminate support poles are known. Thus, the Saddle Tent of U.S. Pat. Nos. 3,990,463 and 3,960,161 is made of one flexible metal or plastic loop permanently attached to the structure's fabric. However, as the authors themselves disclaim: "the use of tie members stabilize the frame and holds it and the remainder of the structure upright which the frame alone cannot do." This is not a free-standing structure and the disadvantages of fastening the structure to the terrain to establish the support element of the structure have been described.

These consequences have prevented prior-art fabric tension structures from easily erecting and effectively gaining popularity.

Accordingly, several advantages of the present invention are:

1. NOVEL SUPPORT ELEMENT

My invention completely eliminated poles which bear weight. Instead, the support element embodied in my invention is a novel fabric-covered steel hoop.

Unlike poles which can bear weight by themselves, this hoop sags into an oval under the slightest load. However, the hoop incorporates a taut non-stretch fabric attached generally at all points to its perimeter, constricting it and thereby preventing sagging. This integrated fabric-cover/hoop maintains its original shape despite bearing considerable weight.

My invention utilizes only a single horizontal rod which acts solely to spread two such fabric-covered hoops and in some embodiments, to prevent them from rolling.

2. INCREASED FLOOR USE AND HEADROOM

The fabric-covered structure of my invention rests on a rectangular floor correlating to the shape of sleeping bags.

My invention's circular design further provides increased headroom as it correlates to the user's upper body movements. It provides more than four times the headroom of comparably-sized wedge structures and as much headroom as dome structures without wasting floor space or requiring additional support poles.

The consistent height of my invention eliminates any apexes and so provides for uncompromising utilization of the headroom throughout the entire length of the structure.

Also, sleeping bags and user gear may be pushed all the way to the edge if desired because the vertical side-walls allow for uncompromised utilization of the floor area.

3. MORE INTERNAL SPACE WITH LESS MATERIAL

Nature's most efficient shape (maximum internal volume with minimum surface area) is a sphere. Due to the novel circular design of my structure, an advantage of my invention is that it encloses more cubic living space per given amount of fabric than any prior-art tension structure. Putting this another way, to provide a structure of given internal size, the tent of my invention requires less fabric.

4. STRONGER

As is well known to those skilled in the art, circles and arches disperse weight evenly and with great stability. A user can lean on the walls of my invention and the circular hoop moves to absorb stress from any direction. It is practically impossible to break the integrated fabric-cover/hoop which can best be described as self-repairing, so collapse or permanent damage to the tent cannot result.

Further, the circular design of my invention deflects loads caused by wind and/or snow. My invention can also be altered for increased windworthiness without changing the tent's structural components. By inclining one or both end-walls of the structure, fabricating the hoops elliptically and/or increasing the acclivity of one or both side-walls, the target size of the structure is reduced for extra dependability in deflecting heavy wind loads and shedding rain or snow in inclement weather.

During the most severe weather, the tent can be further secured by stakes utilized in the normal manner; anchoring is simplified as the structure is already erected and there is no trial and error process associated with finding the exact location for the stakes.

5. EASIER AND SPEEDIER ASSEMBLY

My invention is uniquely easy to recognize during assembly. To set-up, the user shakes the collapsed tent and the resilient hoops "self erect". Because they constitute the opposite end-walls of the structure, the final shape becomes immediately apparent. By spreading apart the end-walls, the segments of the horizontal spreader rod, which are connected by cloth-covered elastic cord, join automatically and one simple connection completes the erection of the structure.

The structure can be set-up by novice or first-time users; the tedious "learning curve" associated with other structures is eliminated. As well as easily introducing new campers to the sport, the simplicity of assembly also enables the structure of my invention to be used as emergency shelter.

6. EASE OF PRODUCTION

The consistent height of my invention minimizes workmanship in the cutting of irregular fabric patterns and also reduces the number of fabric pieces. Sewing is also reduced substantially. Additionally, full widths of material can be utilized eliminating fabric waste.

7. FEWER COMPONENTS

Because the fabric cover/hoop is both the support element and also the structure's end-walls, my tent requires far fewer support members compared to prior-art tents. No weight-bearing poles, sleeves, stakes, tie members, flaps, straps, grommets or guy-lines are needed. Fewer parts can be broken or misplaced; complexity during set-up, tear-down and in-use is reduced; maintenance is minimized.

8. LIGHTER AND LESS EXPENSIVE

Due to the superior strength and efficiency of the circular design, the capability to minimize fabric waste in production, the ease of cutting and sewing, the reduced need for supporting members, etc., as described above, the tent of my invention is lighter in weight and less expensive to produce than all other prior-art fabric tension structures. Containerizing, shipping and insurance costs are correspondingly reduced.

9. SUPERIOR COMPACTABILITY

The tent of my invention folds into a packed, relatively flat disk. The size is a function of internal volume and the number of turns taken in folding the hoop. In one embodiment, three loops are taken and this is sufficient to provide space for small structures; the packed size of this embodiment is smaller than a typical backpack frame for convenient carrying. In another embodiment nine loops are taken to provide space for much larger structures. Weight of the packed disk is evenly distributed and balanced for ease of transport.

It is therefore, an object of the present invention to provide an improved fully freestanding, portable structure.

A second objective of this invention is to provide such a structure which can be erected readily by a single person and, in fact, can best be described as self-erecting.

Another object of the invention is to provide a versatile structure which can be made in a plurality of sizes depending on design parameters.

Still another object of the invention is to provide a structure which can readily be folded into a compact, small size for storage and transportation purposes.

It is further an object of this invention to provide such a structure which is extremely simple and economical to manufacture.

It is a further object of this invention to provide a fully-usable floor, increased headroom and greater cubic living space while using less fabric than prior structures.

It is still a further object to provide a structure light in weight.

A further object is the provision of a novel, inherently integrated design wherein a fabric-covered hoop supports the structure's weight and forms its walls.

A still further object is to provide a rugged, essentially non-breakable structure.

A further object is to provide a stable, windworthy structure.

A still further object is the provision whereby a hoop, fabric therefore and cover cooperate to define a unitary assembly of unique design and decorative appearance.

The above and other objects are realized by the provision of a self-contained freestanding tension structure which in general terms comprises one or more hoops of flexible coilable resilient material affixed to a flexible fabric-like taut sheet material; more particularly, by securement at least at a plurality of points between the fabric and the hoop. The hoop, because of its constraint, assumes a shape in its in-use position corresponding generally to a circle. The circular hoops are spread apart by a segmented rod which exerts tension horizontally and in opposite directions. The frame, as described, is held in the desired in-use configuration by a flexible fabric cover extending between the hoops.

The hoop can take on any of a wide variety of specific configurations. For example, the hoop can be compelled into an oval shape by increasing tension in its covering fabric in either the vertical or horizontal direction. Alternatively, the hoop can be fabricated in an arch shape. Similarly, a hoop having one square corner in an otherwise round or elliptical shape is possible. Further, the hoop may involve extension(s) communicating with the structure's floor. Each embodiment offers separate advantages without compromising the objects of the invention.

The fabric can also take on a wide variety of specific configurations without compromising the invention. For example, the floor can be "stretched" to provide for additional floor space and/or to realize increased acclivity of the side-walls. The structure can also be adapted with openable and extendable side-wall(s) to provide a cabana-like structure with shade-giving awning(s). The fabric can be further adapted to provide space between it and a separate and/or integrated rain fly.

Because of the coilable nature of the support, the structure can be "collapsed" in an orderly fashion by manipulating the hoops in a simple manner as will be described. Upon collapse, the structure assumes a flat circular configuration which is readily portable and which virtually self-erects upon further manipulation.

The features, advantages, and objects of my invention which are explicit and implicit in the foregoing as well as others will become apparent and more fully understood from the following detailed description of the invention made in connection with the accompanying drawings.

DETAILED DESCRIPTION

Figure 3:
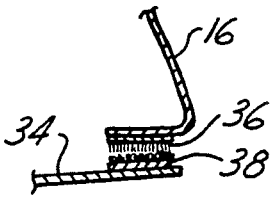
FIG. 3 is a fragmentary sectional view taken on the line 3—3 in FIG. 1.
Figure 1:
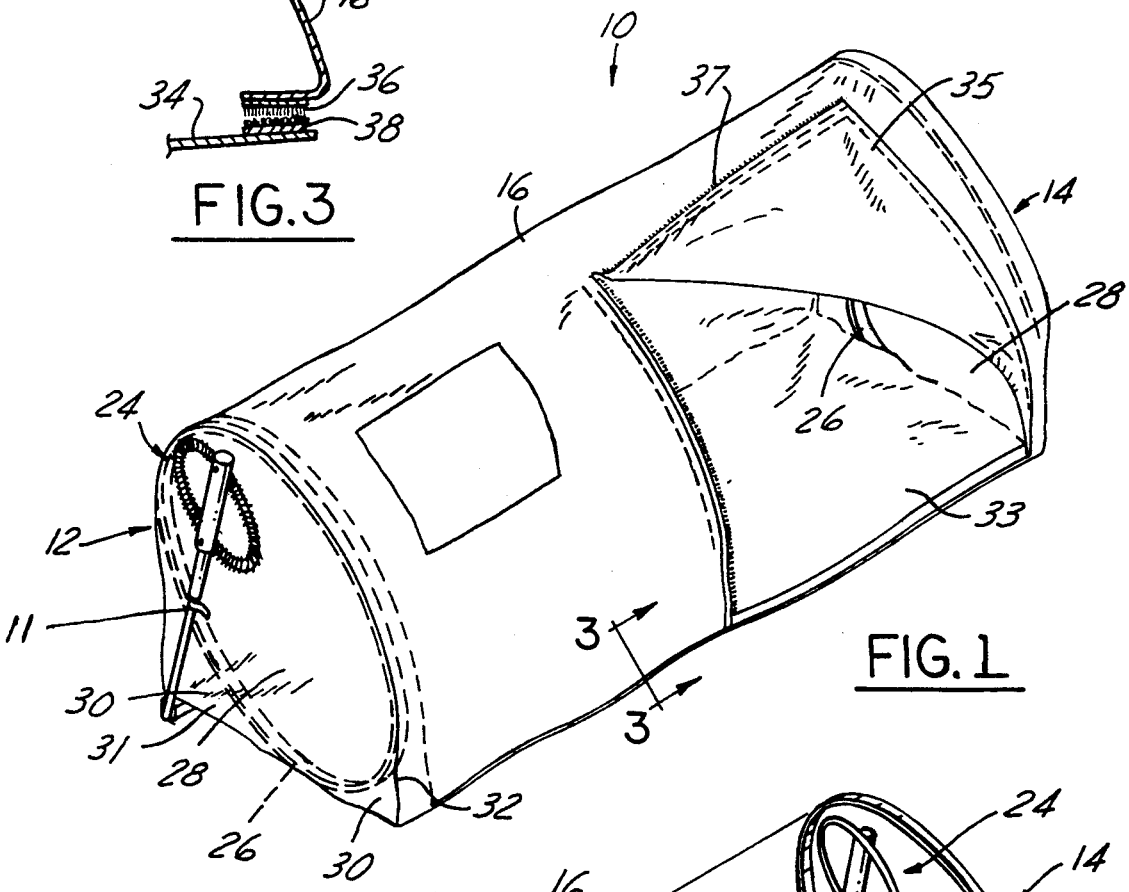
FIG. 1 is a perspective view of a tent constructed in accordance with the invention.
Figure 2:
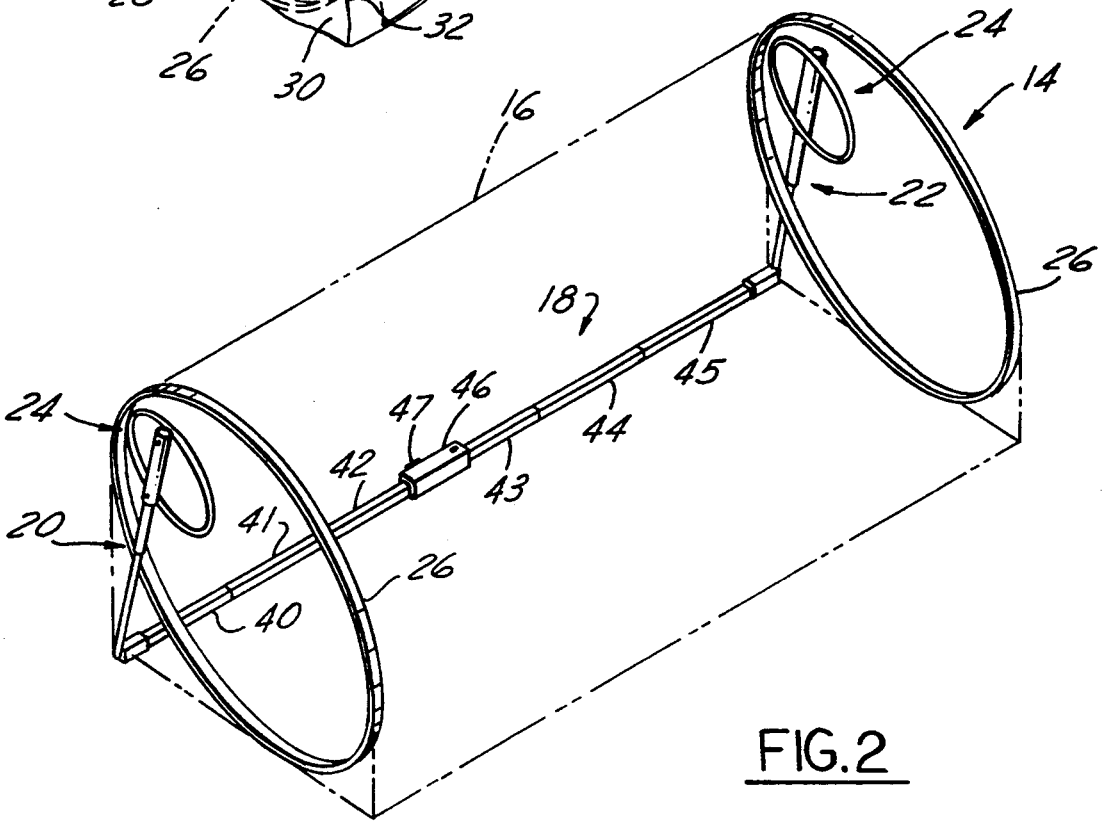
FIG. 2 is a perspective view showing the hardware, including spreader rod, struts, force distributor and end hoops of the tent of FIG. 1, with the fabric in phantom lines.
Figure 5:
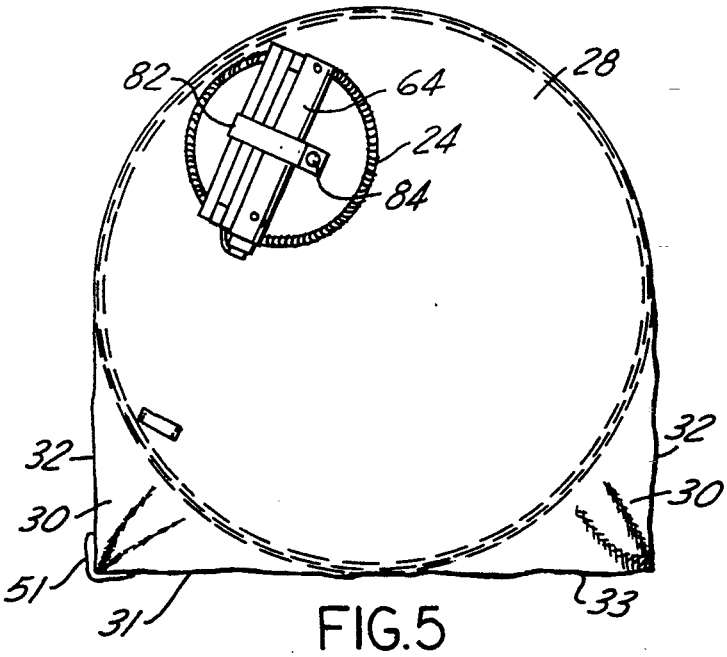
FIG. 5 is similar to FIG. 4 but shows the strut and a portion of the spreader rod in collapsed position.
Figure 6:
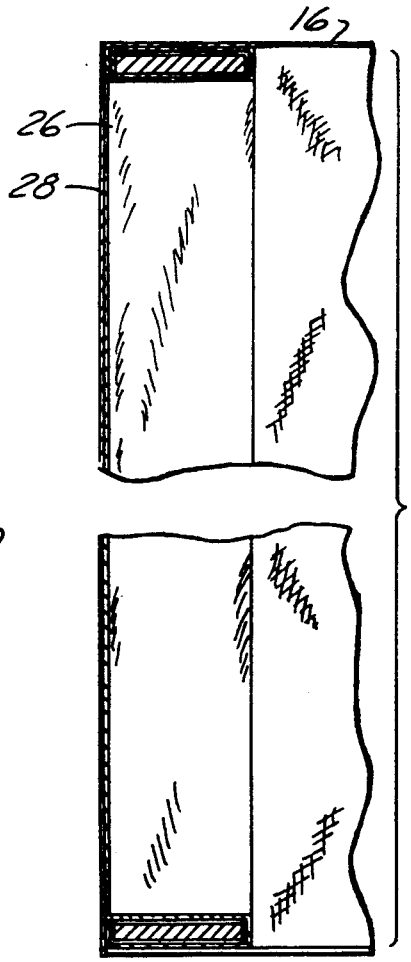
FIG. 6 is a sectional view taken on the line 6—6 in FIG. 4.
Figure 4:
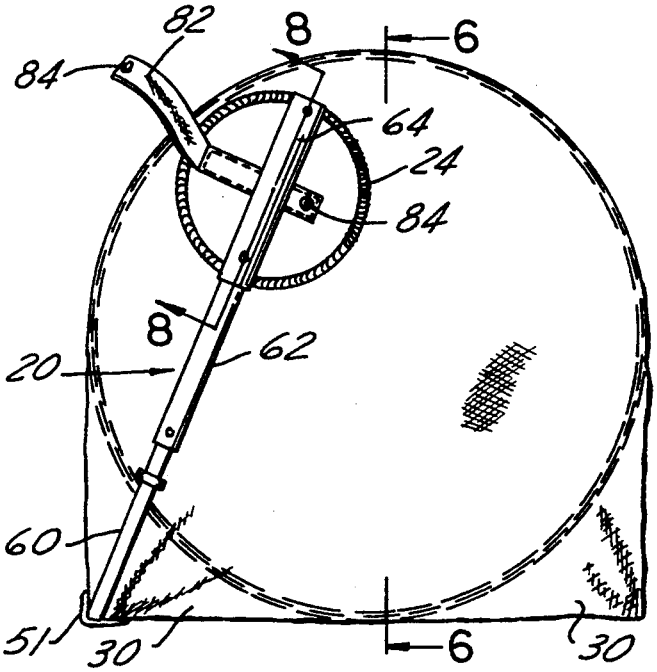
FIG. 4 is an end view of the tent shown in FIG. 1, with a strap added for retaining collapsed hardware.
Figure 7:
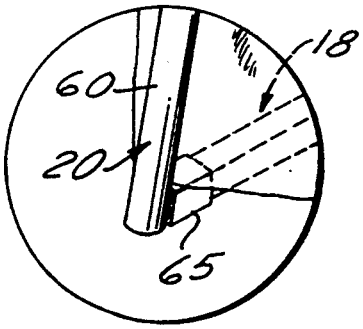
FIG. 7 is an enlargement of a portion of FIG. 4, shown in perspective.
Figure 8:
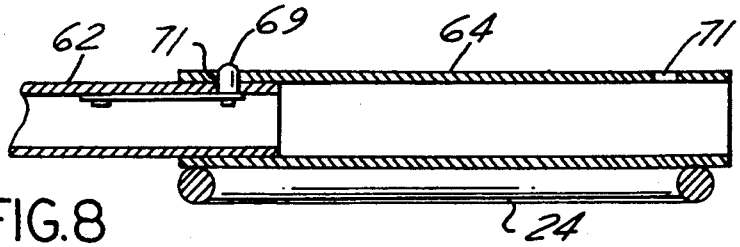
FIG. 8 is a sectional view taken on the line 8—8 in FIG. 4.

Referring now more particularly to the drawings, the enclosure 10 is an elongated portable structure for sheltering one or more persons, commonly referred to as a tent. The structure or tent 10 comprises end panels 12 and 14, a flexible cover 16, and means for holding the end panels in longitudinally spaced, generally upright position including a spreader rod 18 extending between the end panels, struts 20 and 22 connecting the ends of the rods to the end panels, and force distributors 24 carried by the struts.

The end panels are preferably of identical construction, each comprising a circular hoop 26 of flexible, resilient strip material such as spring steel or plastic, for example, and a sheet 28 of substantially non-stretchable flexible fabric. The fabric sheet 28 is circular and its outer edge is permanently secured as by stitching to the hoop throughout at least a major portion of the circumference thereof. The sheet is held taut by the hoop and resists distortion or collapse of the hoop. The end panels also have generally triangular flaps 30 which are integral with the sheets 28 and extend outwardly at the two lower quadrants. Flaps 30 preferably have vertical edges 32 which are tangent to the front and rear extremities of the hoops and bottom horizontal edges 31 which contact the ground.

The cover 16 is of substantially non-stretchable flexible fabric and extends between the end panels 12 and 14. It is held fairly taut by having its ends stitched or otherwise permanently secured to the margins of the end panels, either to the hoops or to the edges of the sheets 28, along either the full periphery or the tops and sides thereof. The sides of the cover 16 preferably extend to the ground. The generally vertical edges of the sides of the cover may be secured to the generally vertical edges 32 of the end flaps either permanently as by stitching or by releasable fasteners. The cover 16 preferably has an opening 33 for ingress and egress which may be closed by a flap 35 and retained closed by a zipper 37 or similar releasable fastening means. The cover 16 may also have a window 19 which may be a simple opening or be covered by a flexible screen or transparent sheet for ventilation and/or viewing.

The tent may be floorless and erected over bare ground, or a rectangular pad 34 may be laid on the ground to cover the ground area enclosed by the tent. The side edges of the pad and the bottom edges of the sides of the cover may be permanently secured as by stitching or removably secured together preferably by fastener strips 36 and 38 of the hook and loop type, commonly known as Velcro fastener strips. The end edges of the pad 34 may be similarly secured to the bottom edges of the end flaps 30.

Figures 9, 10, 11, 12, 13:
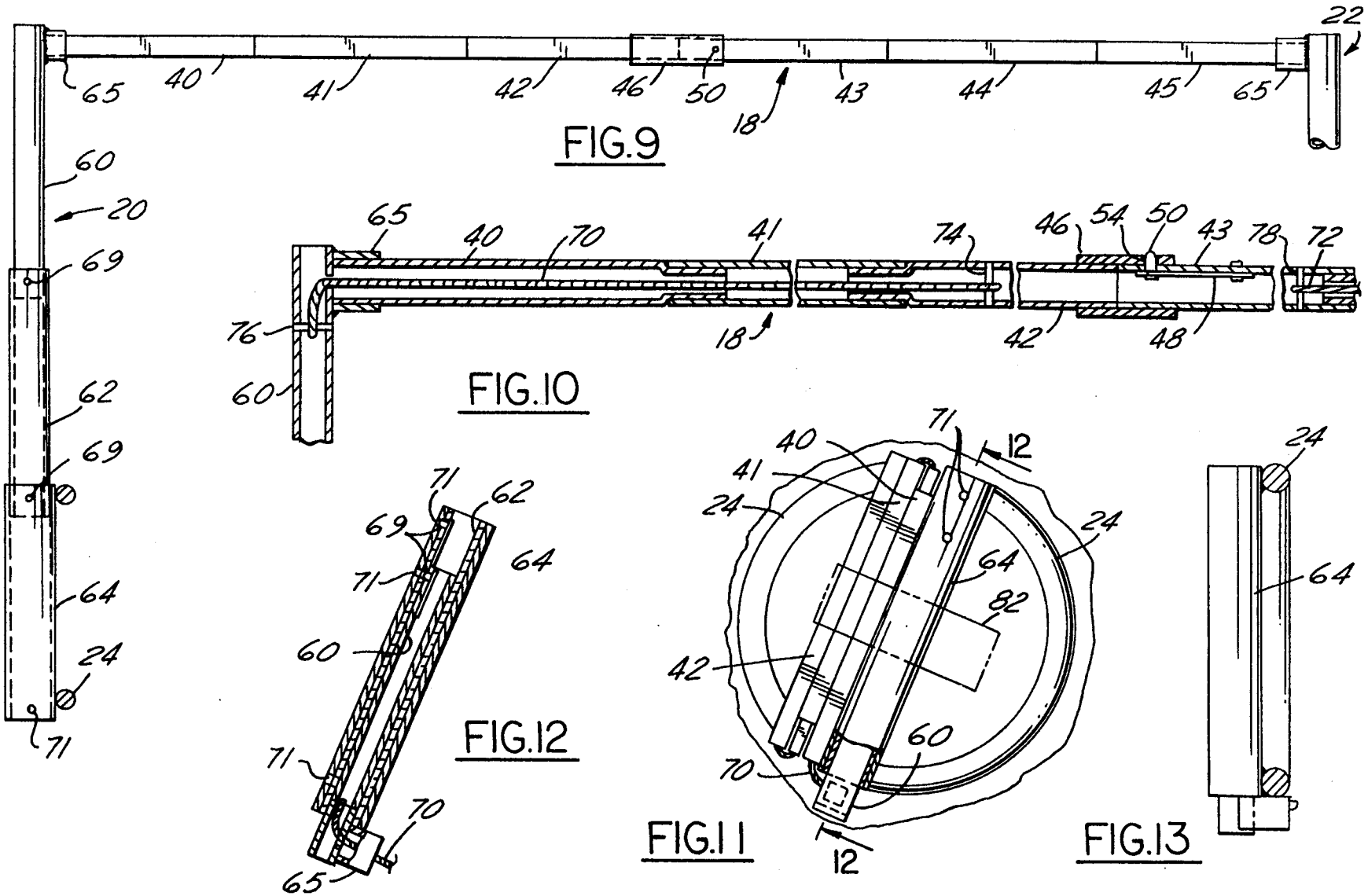
FIG. 9 is a fragmentary view showing the spreader rod and one strut in extended position and also showing a portion of the other strut.
FIG. 10 is a sectional view of a portion of FIG. 9.
FIG. 11 is an enlargement of a portion of FIG. 5.
FIG. 12 is a sectional view of a collapsed strut taken on the line 12—12 in FIG. 11.
FIG. 13 is a sectional view taken on the line 12—12 in FIG. 11, showing the force distributor in section and the collapsed strut in elevation.

The spreader rod 18 is preferably composed of tubular rod segments 40-45. The rod segment 42 has a coupling sleeve 46 secured on one end which receives an end of rod segment 43. Coupling sleeve 46 may, if desired, be releasably connected to the cover 16 as by a fastener 47. A leaf spring 48 within rod segment 43 has one end secured to the rod segment 43 and a pin lock 50 on the other end which projects through an opening 52 in the segment 43. See FIG. 10. The pin lock 50 engages in a hole 54 in the sleeve 46 to releasably lock rod segments 42 and 43 together. The rod segments 40 and 42 have reduced ends fitted in the ends of intermediate rod segment 41, and rod segments 43 and 45 have reduced ends similarly interfitted with intermediate rod segment 44. Straps 51 at spaced points along the bottom of the rear side of the cover 16 loop around the spreader rod to releasably connect the cover and rod together. Straps are also preferably provided at the intersection of the spreader rod and struts.

Each strut 20, 22 is preferably composed of elongated tubular strut segments 60, 62 and 64. The strut segment 60 telescopes within the larger diameter strut segment 62, and the strut segment 62 telescopes within the still larger diameter strut segment 64. The small diameter strut 60 has a sleeve 65 rigidly connected to the side of one end thereof. One end of rod segment 40 is fitted in the sleeve 65 of strut 20, and one end of rod segment 45 is fitted in the sleeve 65 of strut 22. The strut segments have spring mounted pin locks 69 engageable in openings 71 to releasably retain the strut segments in the extended position of FIGS. 1, 2, 4 and 9 or the collapsed position of FIGS. 5 and 11–13.

The force distributor 24 for each strut is secured in surface-to-surface relation to the fabric sheet 28 of an end panel as by stitching. The distributor 24 may, as an alternative or in addition to stitching, be secured directly to the hoop. The force distributor 24 operates to radiate force outwardly from the strut. It may be of any suitable design as long as it fits within an imaginary boundary approximately one-third the hoop dimension and thereby does not interfere with the folding of the hoop. It may, for example, be a star-like figure and spread force along radial lines. It may be an annulus or circular or non-circular design. Each force distributor 24 is preferably a ring-shaped, flat circular member which, because of its width, extends the supporting effect of the strut over a wider area and thus resists the tendency of the end panel to twist or collapse. Strut segment 64 of each strut extends across and is rigidly secured to a force distributor. The struts may be releasably connected to the hoops and/or end panel preferably by a hooking device 11.

When a single spreader rod is employed, the force distributors on the ends of the struts are preferably at the 12 o'clock position. Even though the embodiment of FIGS. 1–15 show the force distributor displaced slightly from 12 o'clock, the 12 o'clock position is preferred.

The rod segments 40-45 are held releasably interengaged by flexible elastic cords 70, 72 disposed within the rod segments under tension. Cord 70 is secured at one end to an anchor 74 in rod segment 42 and is secured at the other end to another anchor 76 in strut segment 60 of one strut 20. Cord 72 is secured at one end to an anchor 78 in rod segment 43 and is secured at the other end to an anchor, similar to anchor 76, in the strut segment 60 of the other strut 22.

When the tent is to be collapsed, the pin lock 50 is depressed to release rod segments 42 and 43. The rod segments 40, 41 and 42 may then be separated and folded side by side, the strut segments 60, 62 and 64 of the associated strut 20 telescoped fully within one another, and the folded rod segments placed alongside the telescoped strut segments. See FIGS. 5, and 11–13. A flexible strap 82 attached to the fabric sheet 28 of the end panel 12 can be wrapped over the folded rod segments and collapsed strut segments and the ends thereof releasably held together by the snap fastener 84. In the same manner, the folded rod segments 43, 44 and 45 may be folded together and placed alongside the collapsed strut segments of the other strut 22 and held attached to the fabric sheet of the other end panel by a similar flexible strap.

Figure 14:
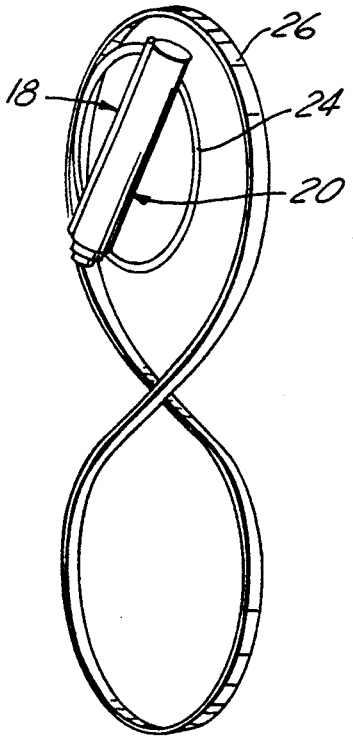
FIG. 14 is an elevational view of an end hoop in a partially twisted position.
Figure 15:
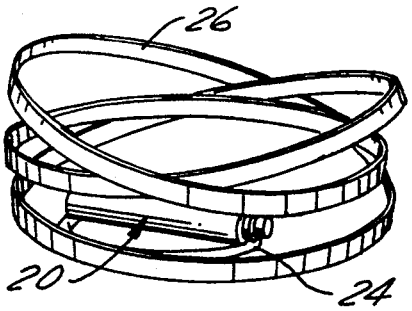
FIG. 15 is a perspective view of the end hoop fully twisted for transportation or storage.

The end panels of the collapsed tent may be twisted into a flat coil of reduced diameter for storage. FIGS. 14 and 15 show the hoop 26 only of an end panel, to illustrate how it may be twisted once (FIG. 14) and then again (FIG. 15) to about one-third its normal size. It will be noted that the force distributor 24 is of a size and shape and so placed that it does not interfere with such twisting of the hoop. Actually, the hoop might be further twisted to one-ninth its normal size, although that might require the force distributor either to be smaller or itself to be collapsible. In embodiments later to be described where force distributors may not be desired, the hoop may quite easily be reduced to one-ninth its normal size. Because the end panels may thus be twisted to a much smaller size, the entire tent structure is capable of being collapsed to a fraction of its dimensions when erect for convenient transportation and storage.

The spreader rod is the preferred means to keep the tent from shifting or rolling about the aligned axes of the hoops. The spreader rod, by reason of its weight and its off-set position on the ground along the rear of the tent, and/or its attachment to the tent cover and to the struts and force distributors, effectively maintains the tent in a stable condition.

It should be understood that the tent shown in FIGS. 1–15 can be readily converted into a cabana by substituting for cover 16 a cover which is entirely open at the front. The front opening might be formed by simply enlarging the access opening 33 so that it extends from one end panel to the other and preferably has grommets in the corners thereof so, with support poles, forms an extended awning or shade porch (not shown) to the structure.

Figure 16:
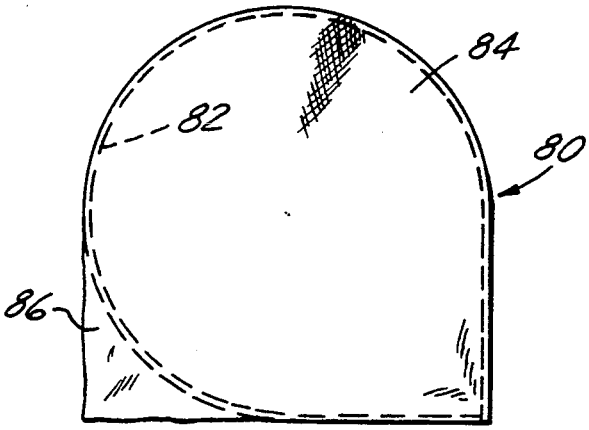
FIGS. 16–19B are diagrammatic views showing different configurations of end panels.

FIG. 16 is a view of an end panel 80 of modified construction which may be substituted for one or both of the end panels in FIGS. 1–15. The annular hoop 82 of end panel 80 in FIG. 16 is circular throughout three quadrants, but the fourth quadrant 83 along the front lower quarter has vertical and horizontal sides. The fabric sheet 84 within the hoop is the same shape as the hoop. It completely fills the hoop and includes one of the flaps of the FIG. 1–15 construction. The other flap 86 remains outside the hoop. With hoops of the FIG. 16 construction, even greater stability is provided because of the increased resistance to rolling. This hoop collapses as previously described.

Figure 17:
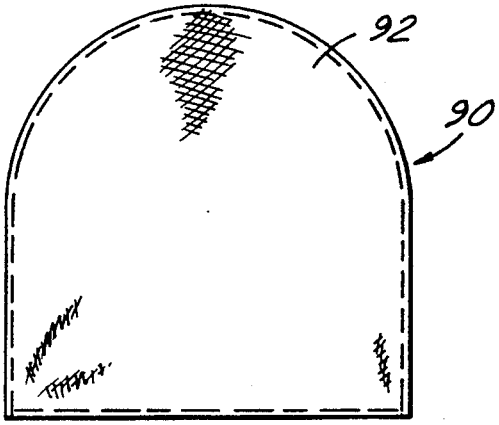

FIG. 17 is a view of another end panel 90 of modified construction which may be substituted for one or both of the end panels of FIGS. 1–15. The upper two quadrants of the annular hoop in FIG. 17 are circular, but the lower quadrants have vertical and horizontal sides. The fabric sheet 92 within the hoop is the same shape as the hoop. It completely fills the hoop and includes both of the flaps of the construction in FIGS. 1–15. The FIG. 17 hoop configuration provides even greater stability for the tent structure. This hoop also collapses as previously described.

Figure 18:
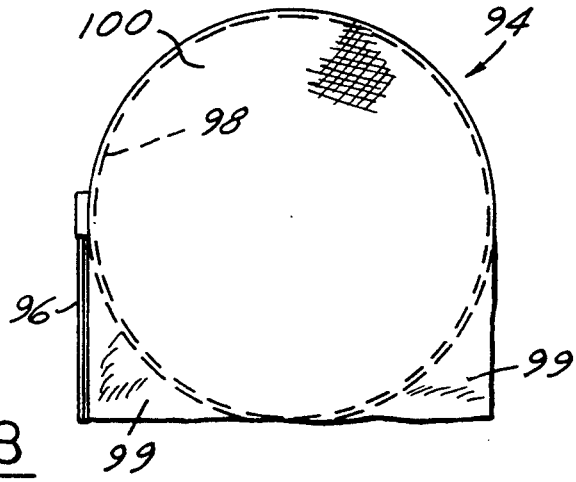

FIG. 18 is a view of an end panel 94 of circular construction, like the end panel in FIGS. 1–15, but has a vertical leg 96 connected to the hoop 98 preferably at the mid-point in its height and extends to the ground. The leg is in the plane of the hoop and may be an integral continuation of the metal or other material forming hoop 98. It is a means to stabilize the tent structure and prevent it from rolling. Also, it neatens the structure by being releasably secured or stitched to the vertical edge of flap 30. Otherwise the end panel shown in FIG. 18 is like the end panel in the first embodiment of FIGS. 1–15, having a fabric sheet completely filling the hoop and flaps 99 like those in the first embodiment, and, with the addition of leg 96, can easily be substituted for one or both of the end panels in the FIG. 1–15 construction.

Figure 19:
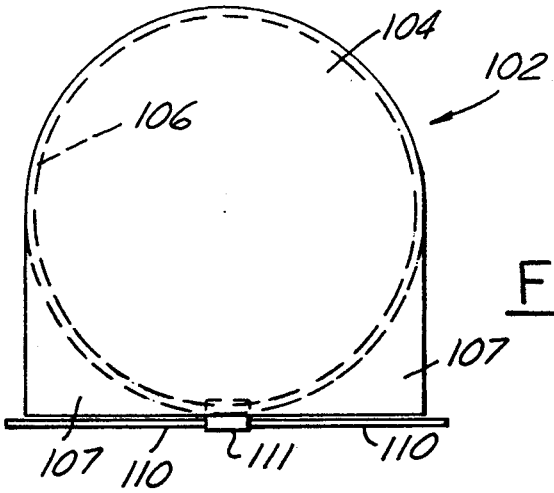

FIG. 19 shows an end panel 102 which is like the end panel in FIGS. 1–15, having the fabric sheet 104 completely filling a circular hoop 106 and flaps 107 beneath the hoop, but at the bottom of the hoop there are horizontal legs 110 connected at 111 to the low point thereof which extend forwardly and rearwardly therefrom in the plane of the hoop. These legs may be integral continuations of the metal or other material forming the hoop 106 and are adapted to rest upon the ground and provide further stability and neatness when secured the vertical edge of flap 30. This end panel can easily be substituted for one or preferably both of the end panels in the construction of FIGS. 1–15.

Figure 19A:
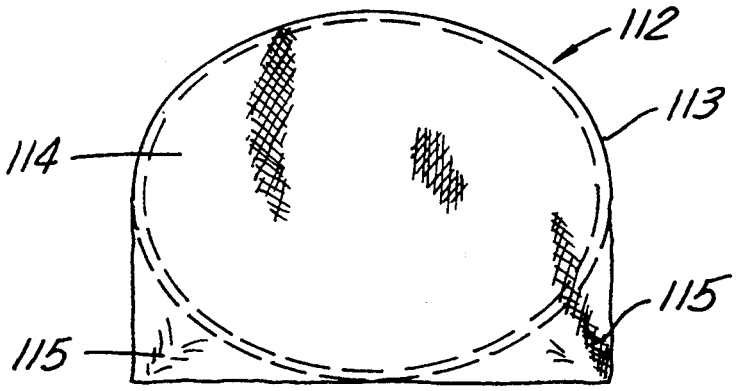

FIG. 19A is a view of an end panel 112 of modified construction which may be substituted for one or preferably both of the end panels in FIGS. 1–15. The annular hoops 113 of end panel 112 is oval shaped, with its major axis horizontal. The fabric sheet 114 fills the hoop 113 and generally triangular flaps 115, similar to those in FIGS. 1–15, extend down to the ground. The end panel 112 provides for increased floor area without increasing overall height. This modification can have all of the features and capabilities referred to in connection with previous embodiments.

Figure 19B:
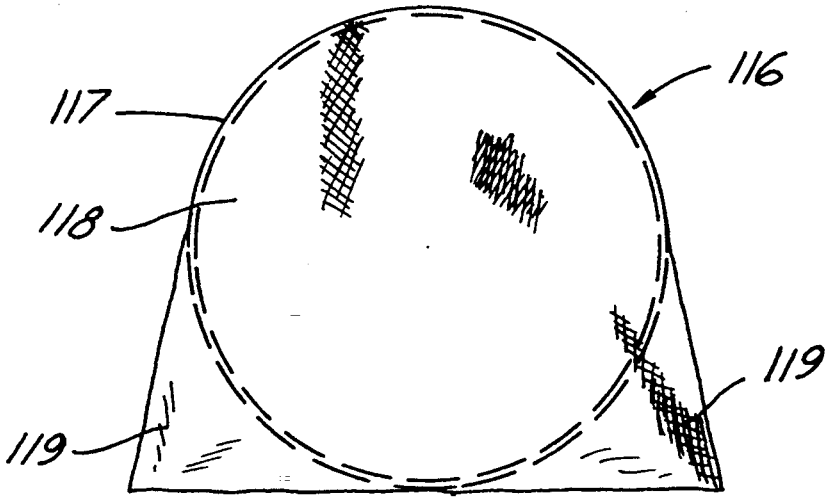

FIG. 19B is a view of an end panel 116 of modified construction which may be substituted for one or preferably both of the end panels in FIGS. 1–15. The annular hoop 117 of end panel 116 is preferably circular. The fabric sheet 118 fills the hoop and the upright edge of the generally triangular flaps 119 slant downwardly and outwardly to the ground for increased floor space. The spreader rod (not shown) at the rear of the structure may be attached to the cover (not shown) and to the rear flap to hold them spread out. At the front, a spreader rod may be similarly attached, or if no front spreader rod is used, the front of the structure may be staked to the ground or held extended by stowage of the user's gear inside the structure. Other features and capabilities of previous designs may also be incorporated in this embodiment.

Figure 20:
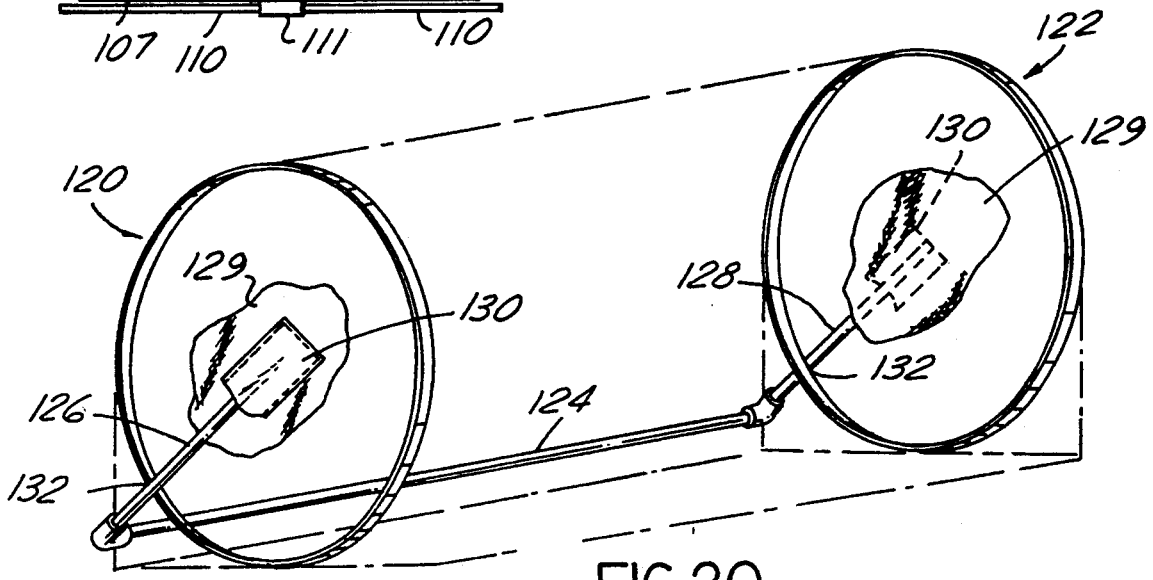
FIGS. 20–25 are diagrammatic views generally similar to FIG. 2 but showing different arrangements of the hardware, including spreader rod, struts and force distributors.

FIG. 20 is a diagrammatic view of a tent of modified construction showing the end panels 120, 122, spreader rod 124, and struts 126, 128, with the cover, which may be the same as in FIGS. 1–15 and attached to the end panels in the same manner, shown only in phantom lines for purposes of clarity. The spreader rod 124 is shown diagrammatically and may consist of a simple elongated rod of one-piece construction as shown or it may be identical to the spreader rod shown in FIGS. 1–15, that is, composed of rod segments and a coupling. The struts may also consist of simple rod-like elements of one-piece construction as shown or be of the same construction as in FIGS. 1–15, but it will be noted that in FIG. 20 the force distributors are omitted. Rather, the struts are secured to the fabric 129 which lines the end panels by engaging in sleeves 130 connected to the fabric. The struts extend across the hoop preferably for a distance greater than one-half the diameter of the hoop. These struts, which are connected to the ends of the spreader rod, may also, if desired, be releasably connected to the hoops and/or end panels preferably by a hooking mechanism at the points indicated 132 and may, if desired, be extended for the full diameter of the hoop and connected thereto also at an opposite point.

Figure 21:
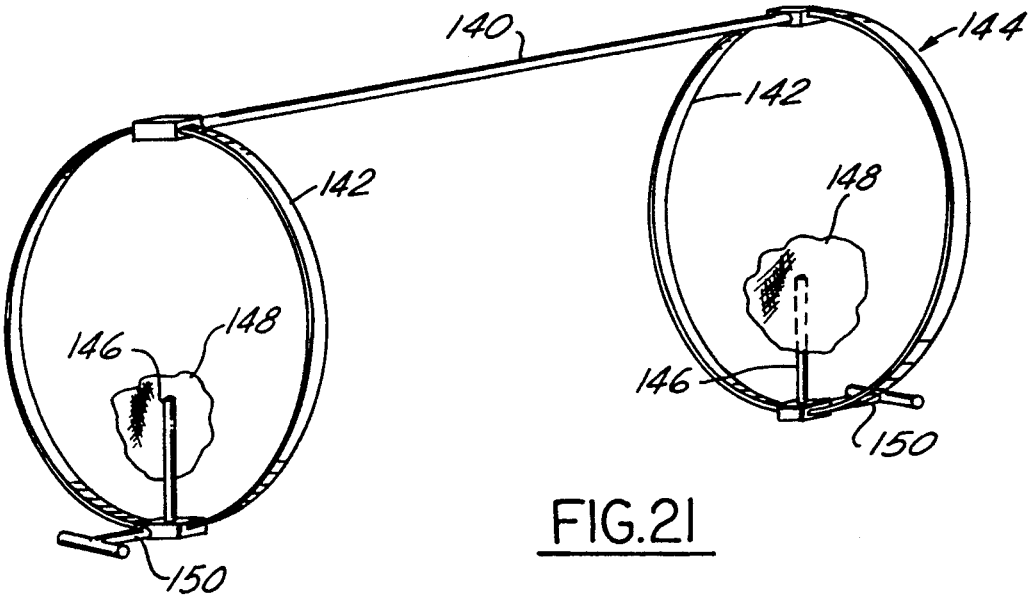

FIG. 21 is a diagrammatic view of a further modification in which the spreader rod 140 is connected at its ends directly to the hoops 142 of the two end panels 144 at a position above the ground. The struts 146 for the two end panels are not connected to the spreader rod but rather are rigidly connected at one end to the hoops and extend radially inwardly therefrom in supporting engagement with the flexible sheets 148 lining the hoops. These struts may be engaged in sleeves provided on the lining material, as in the FIG. 20 construction. Each strut extends vertically on a diametrical line and at its lower end where connected to the hoop is releasably connected to a supporting leg 150 extending horizontally in an inward (not shown) or outward direction for supporting engagement with the ground. These legs may be anchored to the ground by stakes if desired. The spreader rod holds the end panels spaced apart and the end panels are maintained in an upright position by the cooperative action of the struts and the ground supporting legs. No force distributor of the type previously described is provided, but one could be used in place of the strut 146, if desired.

Figure 22:
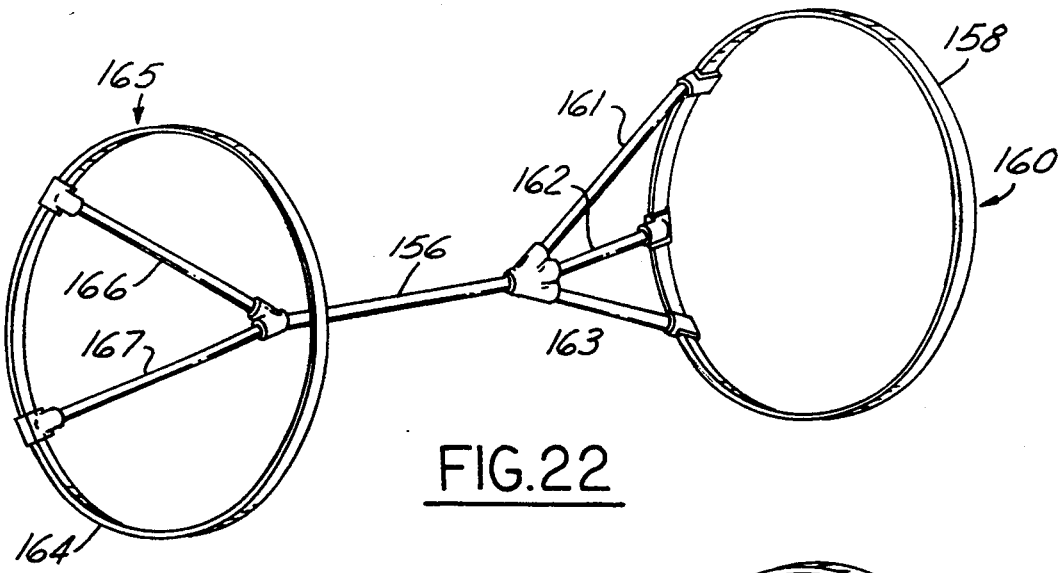

FIG. 22 shows a further modification in which the spreader rod 156 is shown at some distance to the rear of the tent and is connected to the hoop 158 of one end panel 160 by three braces 161, 162, 163 and to the hoop 164 the other end panel 165 by two braces 166, 167. These braces extend from the respective ends of the spreader rod and engage the hoops at angularly spaced points. Preferably the spreader rod is somewhat shorter than the distance between the end panels and the connecting braces extend from the spreader rod ends to the hoops at an acute angle to the longitudinal centerline of the tent, thus bracing the end panels and retaining them spaced apart. In this embodiment, no strut or force distributor is employed, but could be, if desired.

Figure 23:
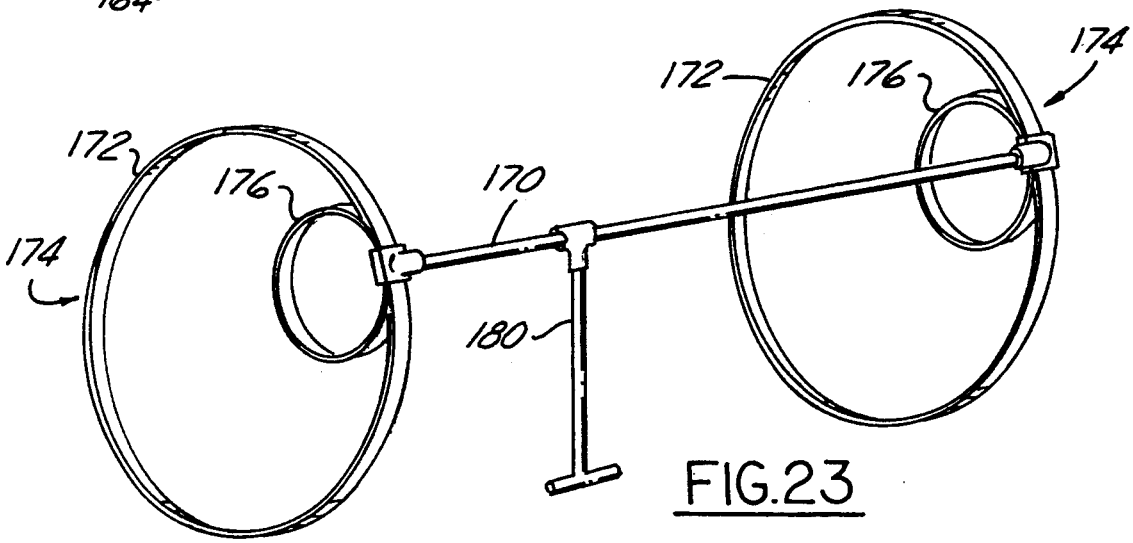

Referring to FIG. 23, the spreader rod 170 is releasably connected at its ends to the hoops 172 of end panels 174 and/or is releasably connected to the circular force distributors 176 which may or may not be stitched or otherwise secured to the fabric sheets (not shown) lining the hoop of the two panels thus maintaining the end panels properly spaced and upright. The spreader rod is shown spaced a distance above the ground and is supported by a stabilizing pole 180 extending from about the mid-point in the length of the rod vertically downward into the ground. No strut is employed in this construction, but could, if desired, be interchanged with the force distributor.

Figure 24:
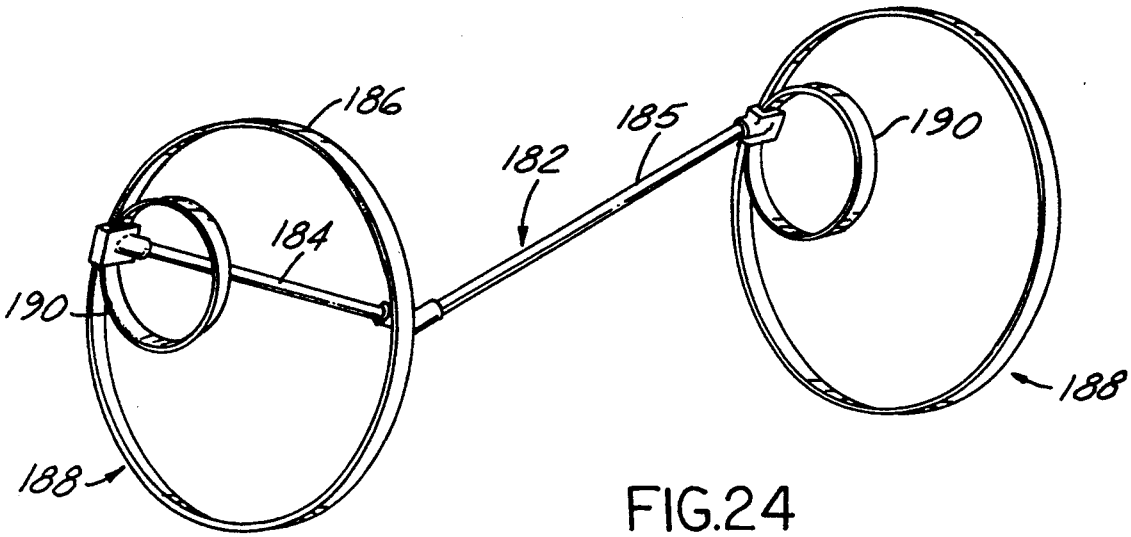

FIG. 24 shows a further modification in which the spreader rod 182 is formed of two angularly related sections 184, 185 which meet at about the mid-point in the length of the rod at which point the rod engages the ground for stability. The opposite ends of the rod are releasably attached to the hoops 186 of the two end panels 188 and/or releasably attached to the circular force distributors 190 to hold the end panels erect. As in the embodiment of FIGS. 1–15, the force distributors may be secured to the fabric sheets (not shown) lining the hoops of the end panels, but do not have to be.

Figure 25:
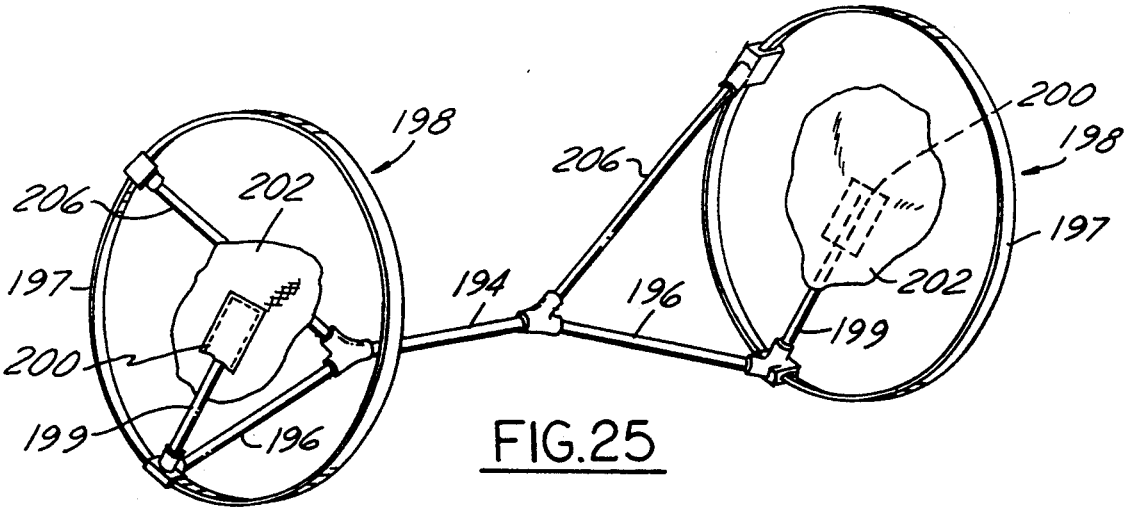

FIG. 25 shows still another embodiment in which the spreader rod 194 has a brace 196 releasably connected to each end. The opposite ends of these braces are releasably connected to the hoops 197 of the end panels 198 and to the outer ends of the struts 199. The struts project generally radially part way across the respective end panels 198 and are preferably secured thereto as by sleeves 200 carried by the cover sheets 202 lining the hoops 197 of the end panels. Additional braces 206 also extending from the end of the spreader rod are releasably secured to the hoops of the two end panels at points angularly spaced from the struts. In this embodiment, the spreader rod rests upon the ground and the additional braces keep the end panels in a stable condition. The additional braces also assist in maintaining the end panels upright without the need for force distributors although such may be used.

The modifications of FIGS. 20–25 show variations in the arrangements of hardware including the spreader rod, struts and force distributors. The tent structure of FIGS. **1–19*b* may be altered to embody these modifications. Also, the spreader rods, braces and struts in FIGS. 20–25 may be of unitary, one-piece construction or of the segmented construction shown in FIGS. 1–15. The cover although omitted for purposes of clarity in these modifications, may be the same as in FIGS. 1–19*b*** and attached to the end panels in the same way.

Figure 26:
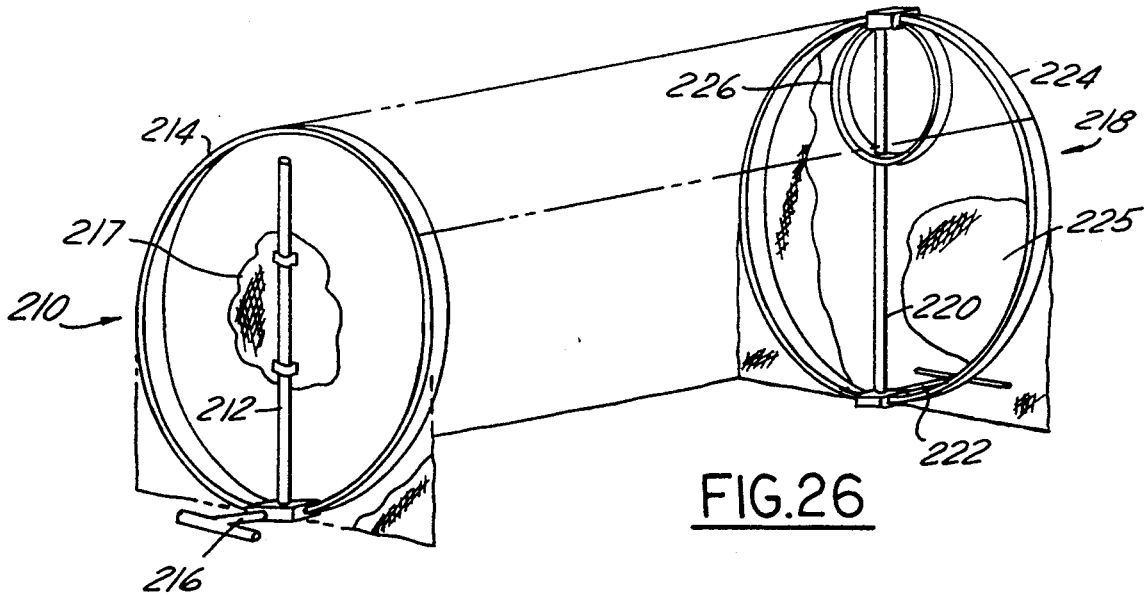

It should be understood that while a spreader rod is desirable, it is not always required. FIG. 26 shows a further modification in which one end panel 210 preferably has a strut 212 releasably connected to the hoop 214 thereof and also to a brace 216. The strut may, if desired, be of a one-piece unitary construction or segmented as previously described and extends preferably on a diameter part way across the end panel and may if desired be secured to the fabric sheet 217 which lines the end panel. The brace is at right angles to the strut and rests upon and is anchored to the ground either inside (not shown) or outside the tent. The other end panel 218 can be identical to the first or vice versa, but as shown has a strut 220 of one-piece or segmented construction and a perpendicular brace 222 releasably connected to one another and to the hoop 224 so that the brace 222 extends inside (not shown) or outside the tent along the ground and is anchored thereto. The strut 220 extends preferably diametrically across the hoop 224 and is releasably connected to the hoop at both ends. A circular force distributor 226 may be employed in this end panel, being releasably secured to the strut 220 and also, if desired, directly to the hoop 224 or to the fabric sheet 225 lining the end panel.

Figure 27:
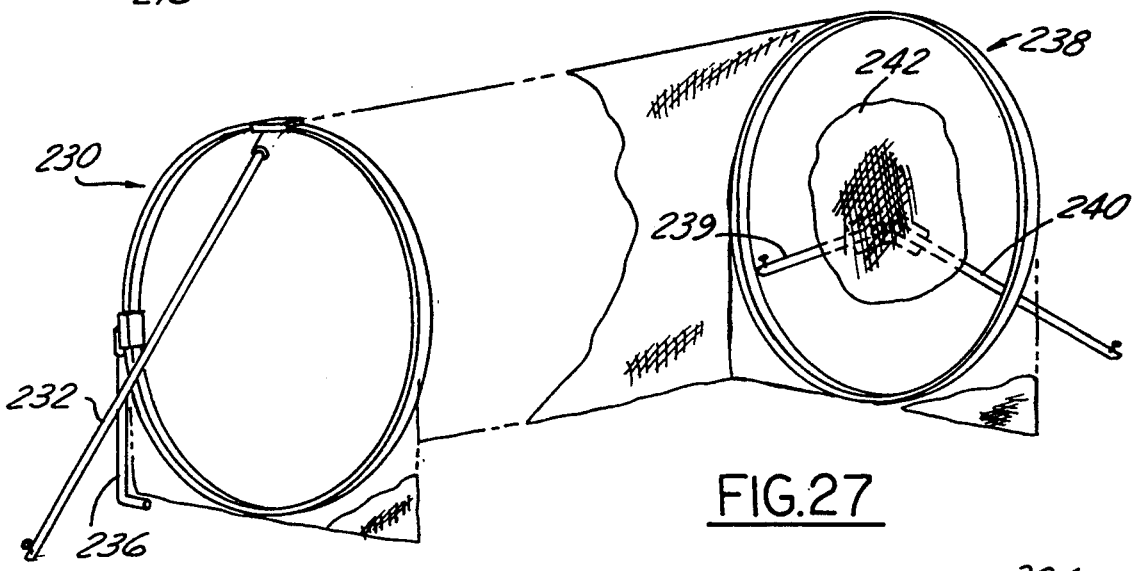

FIG. 27 shows a further modification in which one end panel 230 is supported by an elastic cord 232 connected at one end to approximately the top of the hoop 234 and having its opposite end anchored to the ground at a point spaced longitudinally of the end panel outside the tent. This end panel 230 is preferably supported by a vertical leg 236 extending from approximately the rearmost mid-point of the hoop to the ground. Leg 236 may be an integral continuation of the material forming the hoop 262. The other end panel 238 can be identical to the first and vice versa, but as shown is supported by elastic cords 239 and 240 connected generally at the mid-point of the fabric sheet 242 lining the end panel 238. These braces extend beyond the end of the tent in diverging relation and are anchored in the ground.

Figure 28:
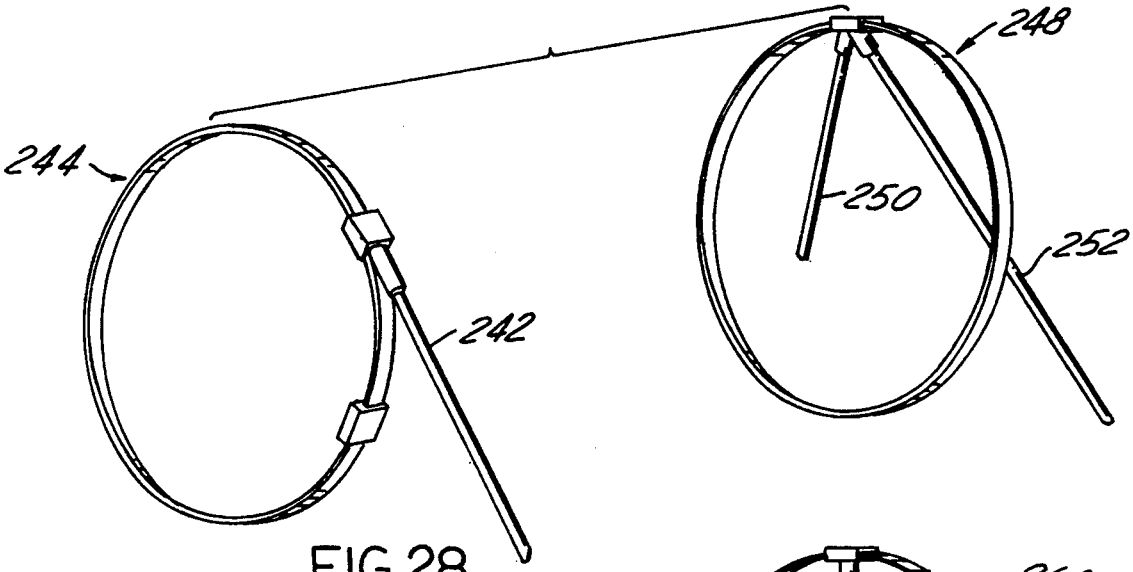
FIGS. 26–29 are diagrammatic views showing various different arrangements or hardware for the tent structure but without a spreader rod.

Referring to FIG. 28, a further modification is seen in which a brace 242 for one end panel 244 has one end releasably secured to the hoop thereof near the top and the other end anchored in the ground at a point on the outside of the tent spaced to the side of and slightly beyond the end panel to which it is secured. The other end panel 248 can be identical to the first and vice versa but as shown is supported by two braces 250 and 252 which are releasably connected at the same point approximately to the top of the hoop and extend beyond one end of the tent and in laterally diverging relation beyond one end of the tent to points where they are anchored in the ground.

Figure 29:
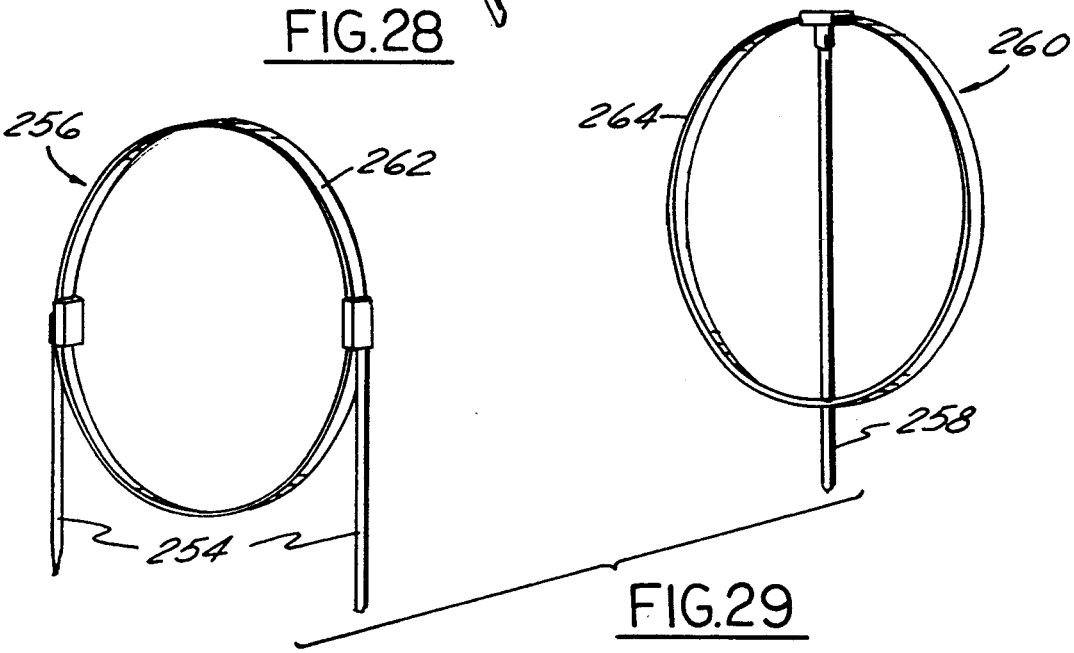

FIG. 29 shows a further modification in which legs 254 on opposite sides of end panel 256 are releasably secured to the hoop 262 at points approximately midway of the height thereof and extend downwardly where they are anchored in the ground. Legs 254 and 258 may be integral continuations of the material forming the hoop 262. The other end can be identical to the first and vice versa, but as shown has a leg 258 releasably secured to approximately the top of the hoop 264 and extends generally vertically downwardly where it is anchored in the ground. The hoops are thus each rigidly supported and held in an erect position without the use of a spreader rod, strut or force distributor although such may be used, if desired.

The foregoing examples shown in FIGS. 20–29 of modifications in the bracing and support of the end panels can be incorporated into the basic structure shown in FIGS. 1–19*b*. The cover in these modifications may be the same as in FIGS. 1–19B and attached to the end panels in the same way.

Referring now to FIGS. 30–33, the tent there shown is similar in many respects to the tent in FIGS. 1–15, having end panels 270 and 272, a flexible cover 274, and means for holding the end panels in longitudinally spaced, generally upright positions including in this case a pair of spreader rods 276 extending between the end panels, and struts 278 connecting the ends of the rods to the end panels.

The end panels are preferably of identical construction, each comprising a circular hoop 278 of flexible, resilient strip material such as spring steel or plastic, for example, and a sheet 280 of substantially non-stretchable flexible fabric which lines the interior of each hoop and has its outer edge permanently secured as by stitching to the hoop throughout a major portion of its full circumference, being held taut by the hoop and resisting distortion or collapse of the hoop. The end panels also have the generally triangular flaps 282 and 284 extending outwardly at the two lower quadrants, as in the embodiment of FIGS. 1–19*b*.

The cover for the tent extends between the end panels and is held reasonably taut by having its ends stitched or otherwise permanently secured to the margins of the end panels, either to the hoops or to the edges of the sheets along either the full periphery or the tops and sides of the end panels. The sides of the cover preferably extend to the ground with their vertical edges secured to the vertical edges of the end flaps in the same manner as in FIGS. 1–15. The cover also has an access opening 286 closed by a flap 288 as in the embodiment of FIGS. 1–15. The tent in this embodiment may be floorless or may have a floor if desired, as previously described.

The spreader rods can be of somewhat different construction than previously described, having tubular rod segments 290 arranged end-to-end and with one end of each reduced somewhat in diameter to fit tightly within the end of the adjoining segment. The endmost rod segments have a right angle bend 292 for connection to a hollow strut 278. These right angle end portions are of reduced diameter to fit with the hollow struts. An elastic flexible linear member 294 extends throughout the length of each spreader rod and associated strut, being anchored at 295 at the ends in the struts and holding the rod segments and struts releasably interengaged.

The struts extend along the end panels in engagement with the fabric sheets lining the hoops of the end panels, and are disposed preferably in sleeves 296 stitched to the lining sheets as shown. One spreader rod extends lengthwise of the tent along the ground at the rear of the tent and the other spreader rod extends lengthwise of the tent along the ground at the front of the tent. The struts which engage the end panel at one end of the tent extend at about a right angle to one another, as do the struts which engage the end panel at the opposite end of the tent. The struts thus support the end panels in erect condition and, together with the spreader rods, provide stability. The bottoms of the side portions of the cover are preferably releasably connected to the spreader rods by straps 298.

Figure 30:
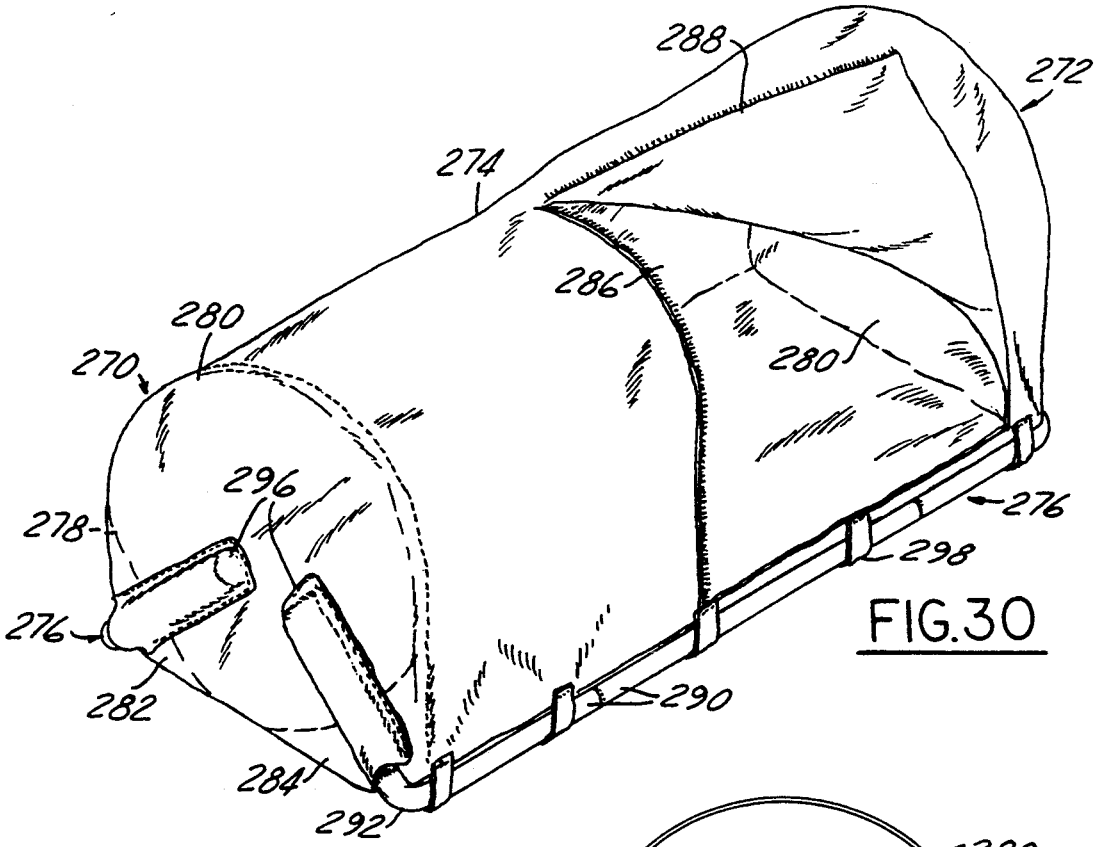
FIG. 30 is a perspective view of a tent of modified construction.
Figure 32:
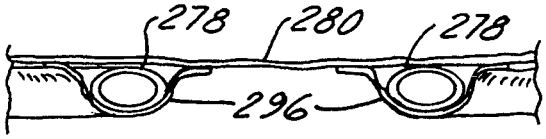
FIG. 32 is a sectional view taken on the line 32—32 in FIG. 31.
Figure 31:
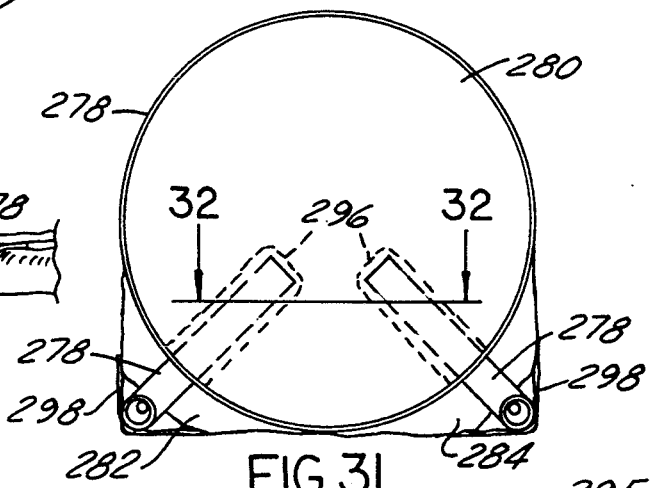
FIG. 31 is a transverse section of the tent of FIG. 30.
Figure 33:
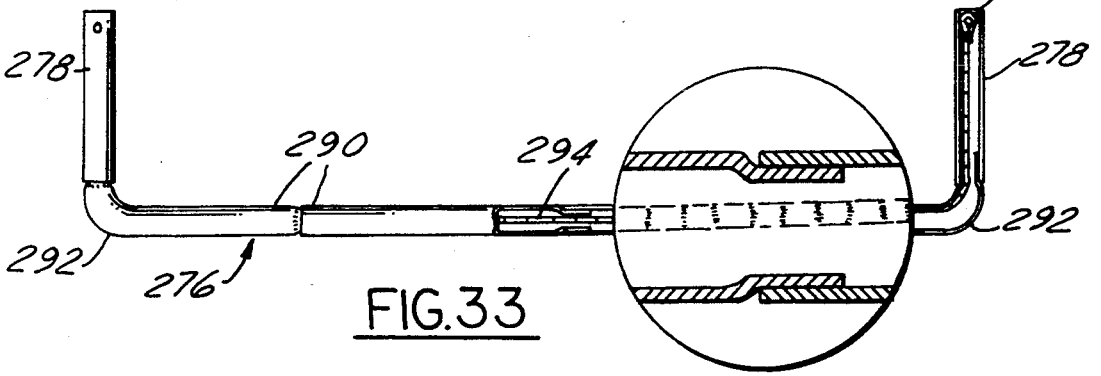
FIG. 33 is a view partly in section of one of the spreader rods and the two struts associated therewith.

The foregoing examples in the arrangement of hardware including the spreader rod, struts, force distributors and bracing support of the end panels in FIGS. 1–25 can be incorporated in the structure of FIG. 30, however requiring pairing of the hardware because two spreader rods are used.

Figure 34:
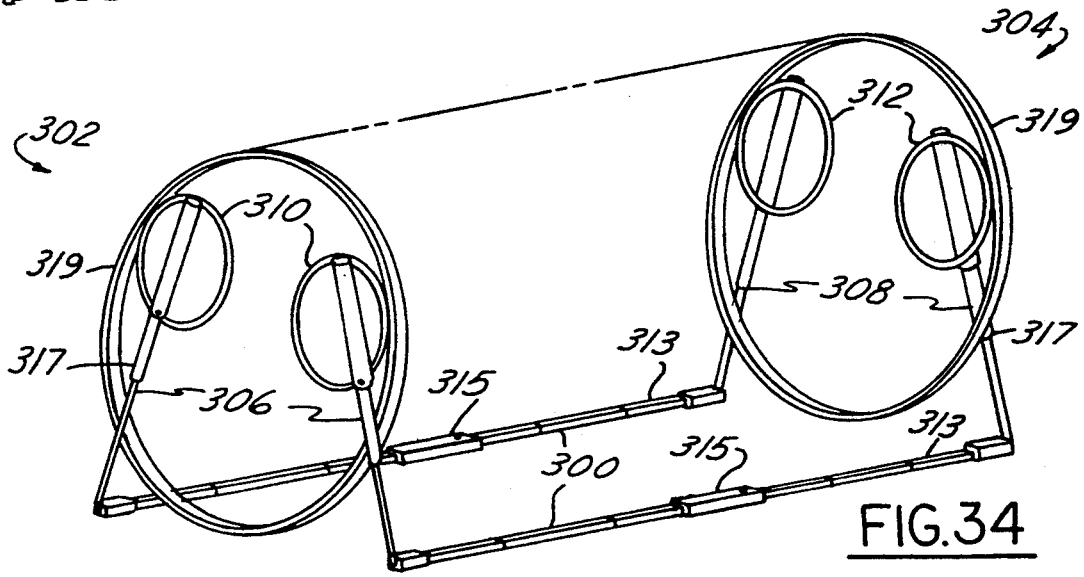
FIGS. 34 and 35 diagrammatically show further modifications.

For example, FIG. 34 shows a modification of the construction in FIGS. 30–33, having a pair of spreader rods 300 extending between the end panels 302 and 304, struts 306 and 308 connecting the ends of both rods to the two end panels, and force distributors 310 and 312 carried by the struts on the ends of the rods. Preferably, the force distributors 310 and 312 are at the 10 o'clock and 2 o'clock positions as shown. This structure collapses as described previously.

The spreader rods and struts may be of the construction shown in FIGS. 1–15 in which the rods have tubular rod segments 313 and an intermediate coupling 315 held together by an elastic element (not shown) and the strut segments 317 which telescope within one another between the extended position shown and a collapsed position similar to that shown in FIGS. 5 and 11–13. The force distributors 310 and 312 are flat ring-shaped members permanently secured to the end segments of the struts and also preferably secured as by stitching to the fabric lining the end panels to hold the end panels erect. The force distributors may also be secured to the hoops 319 of the end panels. The couplings 315 of the spreader rods may have fasteners for attachment to the cover which extends between the end panels.

Figure 35:
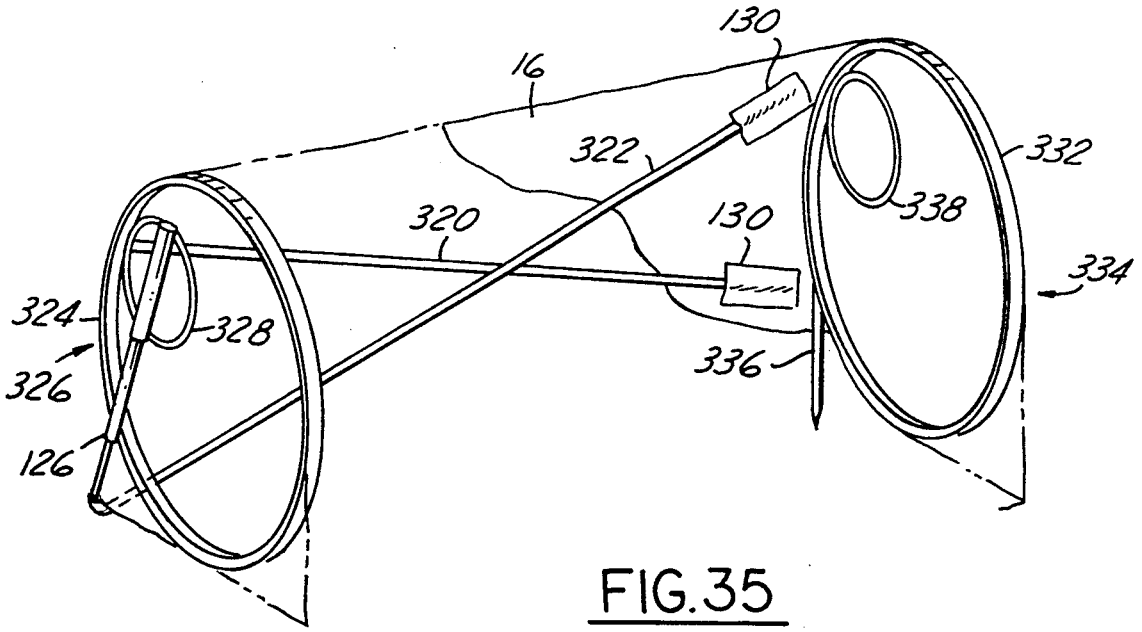

FIG. 35 shows a further modification in which the structure incorporates two spreader rods 320 and 322 disposed in crossing relation to one another. These spreader rods may be of the segmented construction previously shown or they may be of a unitary one-piece construction. One end of one of the rods 320 is releasably secured to the hoop 324 of one end panel 326 and/or to a circular force distributor 328 which is adapted to bear against the fabric lining of that end panel to hold it erect. The other end of the spreader rod 320 may be releasably affixed to the cover 16 by a flexible fabric sleeve 130 near to the other end panel 334. The spreader rod 322 can be identical to the first and vice versa, or as shown has one end releasably connected to the lower segment of strut 126 of end panel 324. The opposite end of this second spreader rod 322 is releasably affixed to the fabric cover 16 by a flexible fabric sleeve 130 near the end panel 334. End panel 334 may be identical to the end panel 324 and vice versa, and as shown has a vertical leg 336 which communicates with or goes down into the ground. When both rods terminate above the ground, a means such as leg 336 or other means as pictured in FIGS. 16–19 is used to prevent rolling of the structure. The crossing relationship of the spreader rods adds stability to the tent structure.

Figure 36:
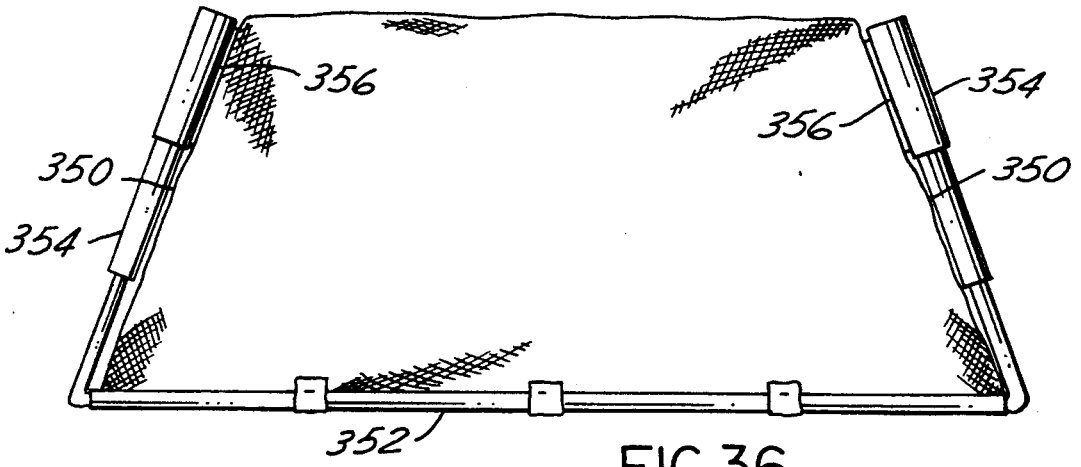
FIGS. 36 and 37 are elevational views showing tents having different configurations.

FIG. 36 illustrates diagrammatically a tent similar to that shown in FIGS. 1–15 but in which the end panels 350 are slanted upwardly and inwardly to increase the windworthiness of the structure. Otherwise, the tent of FIG. 36, including the spreader rod 352, struts 354 and force distributors 356 may be as shown and described in connection with FIGS. 1–19*b*.

Figure 37:
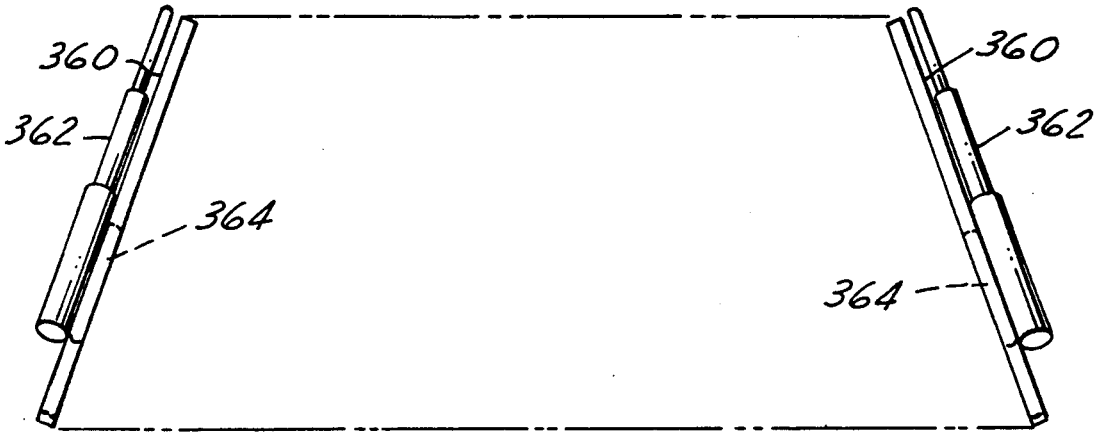

FIG. 37 illustrates diagrammatically a tent similar to that shown in FIGS. 1–15 but in which the end panels 360 are diverge in a forward direction to provide a wider front to the structure. Otherwise the tent of FIG. 37, including the spreader rod (at the rear and not shown), struts 362 and force distributors 364 may be as shown in connection with FIGS. 1–19*b*.

Several important points should be noted regarding the invention and the several embodiments disclosed. Regarding the struts, those shown as unitary, one-piece members in certain embodiments may be telescoping as in other embodiments, and those shown as telescoping may be unitary. They may also be segmented and likewise the spreader rods in all embodiments may be either segmented or of a unitary, one-piece construction. The spreader rods may also telescope as previously described.

The end hoops in all embodiments disclosed are preferably of a flexible, resilient material capable of being collapsed to one-third their normal size, as shown in FIGS. 14 and 15. It should be understood that one end hoop may be rigid and approximately one-third the diameter of the other and the tent will still be collapsible to the smaller dimension. Also, all of the end panel hoop configurations of the several embodiments herein disclosed are interchangeable with one another. Likewise, the force distributors and struts of the several embodiments are interchangeable.

Some of the embodiments employ one spreader rod and others two. When only one spreader rod is employed with struts at the ends for supporting the end panels as in FIG. 1, the length of the struts is preferably greater than one-half the diameter of the hoop of end panels. Also, the struts are preferably telescoping and collapsible to facilitate folding of the tent. If two spreader rods are employed, with struts at the ends of both, as in FIG. 30, the length of the struts may be less than one-half the diameter of the end panels. If only one-third the diameter of the end panels, the struts may be of a one-piece, non-collapsible construction without interfering with the folding of the tent.

The spreader rod or rods may be inside or outside the tent cover. If outside and made of interfitting segments as in FIGS. 1–13, the segments are preferably non-circular to resist the tendency for them to rotate, and possibly reduce the stability of the erected tent structure. The struts may also be inside or outside the tent. If either inside or outside, and made of interfitting segments, the segments are preferably non-circular to resist the tendency for them to rotate, and possibly reduce the stability of the erected tent structure.

What is claimed is:

1. An elongated portable structure for use as a tent or the like, said structure having an end panel at each end thereof, each said end panel comprising an annular hoop of flexible, resilient, strip material, a sheet of substantially non-stretchable, flexible fabric in the space within each hoop and marginally secured to said hoop to maintain said sheet of fabric taut and to resist collapse or distortion of said hoop, means for holding said end panels in longitudinally spaced, generally upright positions, a flexible fabric cover extending between and cooperating with said end panels to provide shelter for a person or persons occupying the structure, and means providing an entry to said structure, at least one of said hoops being capable of being twisted into a flat coil of reduced diameter for storage.

2. Structure as defined in claim 1, further including means to prevent said structure from rolling.

3. Structure as defined in claims 1 or 2, wherein said holding means includes at least one elongated spreader rod extending between said end panels and connected to said cover.

4. Structure as defined in claims 1 or 2, wherein said holding means includes at least one elongated spreader rod extending between said end panels, and support means operatively connected said rod to said end panels.

5. Structure as defined in claims 1 or 2, wherein said holding means comprises an elongated spreader rod extending generally lengthwise of said structure, and said rod comprises a plurality of separable rod segments connected together end-to-end.

6. Structure as defined in claim 5, wherein at least two of said rod segments are connected end-to-end by a releasable coupling.

7. Structure as defined in claim 6, further including means for attaching said couplings to said cover.

8. Structure as defined in claim 4, wherein said rod comprises a plurality of separable, tubular rod segments interfitted together end-to-end, and an elongated, flexible, stretchable elastic member extending lengthwise of and within said rod segments to hold said rod segments interfitted as aforesaid.

9. Structure as defined in claim 4, wherein said rod comprises a plurality of rod segments and a coupling, said rod segments are tubular and a group at least two of said rod segments at one end of said coupling are connected together end-to-end and a group at least two of said rod segments at the other end of said coupling are connected together end-to-end, and means for holding said rod segments and coupling together comprising elongated, flexible, stretchable elastic members secured to said coupling and extending lengthwise of and within said respective groups of rod segments.

10. Structure as defined in claim 9, wherein said rod segments are capable of being separated from one another and folded for storage.

11. Structure as defined in claim 10, and further comprising releasable retainer means for holding said rod segments folded against the collapsed hoop.

12. Structure as defined in claim 4, wherein said support means includes at least one strut connected to one end of said rod, said strut attached to one of said end panels to hold it upright as aforesaid.

13. Structure as defined in claim 12, wherein each said strut comprises a plurality of separable strut segments connected together end-to-end.

14. Structure as defined in claim 12, wherein each said strut comprises a plurality of strut segments telescoped together to permit movement of said strut segments from an extended, operative position to a collapsed position one within another for storage.

15. Structure as defined in claim 12, wherein each said strut extends completely across the end panel to which it is attached and is connected to the hoop thereof at opposite points.

16. Structure as defined in claim 4, wherein said support means further includes at least one relatively rigid distributor in supporting engagement with the sheet of one of said end panels, and being relatively flat and disposed parallel to and in surface-to-surface contact with said sheet of said one end panel.

17. Structure as defined in claim 16, wherein the hoop of said one end panel is the hoop which is capable of being twisted into a flat coil of reduced diameter for storage as aforesaid and said distributor is of a size and shape such that it will not interfere with such twisting of said hoop.

18. Structure as defined in claim 16, wherein said distributor is connected to the hoop of said one end panel.

19. Structure as defined in claim 16, including means connecting said distributor to one end portion of said rod.

20. Structure as defined in claim 19, wherein said means connecting said distributor to said one end portion of said rod is an elongated strut.

21. Structure as defined in claims 1 or 2, wherein said cover open at the bottom to provide a substantially floorless structure.

22. Structure as defined in claims 1 or 2, wherein said holding means comprises a pair of laterally spaced, elongated spreader rods extending generally lengthwise of said structure, and wherein at least one end of at least one said rod is connected to said cover.

23. Structure as defined in claims 1 or 2, wherein said holding means comprises a pair of laterally spaced, elongated spreader rods extending generally lengthwise of said structure, and support means operatively connecting said rods to said end panels.

24. Structure as defined in claims 1 or 2, wherein said holding means comprises a pair of laterally spaced, elongated spreader rods extending generally lengthwise of said structure, and each of said rod comprises a plurality of separable rod segments connected together end-to-end.

25. Structure as defined in claim 24, wherein each said rod comprises a plurality of separable, tubular rod segments interfitted together end-to-end, and an elongated, flexible, stretchable elastic member extending lengthwise of and within said rod segments to hold said rod segments interfitted as aforesaid.

26. Structure as defined in claim 24, wherein at least two rod segments of each rod are separable and connected end-to-end to a releasable coupling.

27. Structure as defined in claim 26, further including means for attaching said couplings to said cover.

28. Structure as defined in claim 24, wherein said rod segments of each of said rods are tubular, a group of at least two of said rod segments of each rod are at one end of said coupling thereof, a group of at least two of said rod segments of each rod are at the other end of said coupling thereof, and means for holding said rod segments and coupling of each said rod together comprising elongated, flexible, stretchable elastic members secured to the coupling thereof and extending lengthwise of and within said respective groups of rod segments at the ends of said coupling.

29. Structure as defined in claims 1 or 2, wherein said holding means comprises a pair of elongated spreader rods extending generally lengthwise of said structure and wherein said rods are disposed in cross relation to one another.

30. Structure as defined in claim 24, wherein at least one end of at least one said rod is connected to one of said hoops.

31. Structure as defined in claim 24, wherein said support means includes at least one strut connected to one end of one of said rods, said strut being attached to one of said end panels to hold it upright as aforesaid.

32. Structure as defined in claim 31, wherein said strut comprises a plurality of strut segments connected together end-to-end.

33. Structure as defined in claim 31, wherein said strut comprises a plurality of strut segments telescoped together to permit movement of said strut segments from an extended, operative position to a collapsed position one within another for storage.

34. Structure as defined in claim 24, wherein said support means further includes at least one relatively rigid distributor in supporting engagement with the sheet of one of said end panels, said spreader being relatively flat and disposed parallel to and in surface-to-surface contact with said sheet of said one end panel.

35. Structure as defined in claim 34, wherein the hoop of said one end panel is the hoop which is capable of being twisted into a flat coil of reduced diameter for storage as aforesaid and said distributor is of a size and shape such that it will not interfere with such twisting of said hoop.

36. Structure as defined in claim 34, wherein said distributor is connected to the hoop of said one end panel.

37. Structure as defined in claim 34, including means connecting said distributor to one end portion of at least one said rod.

38. Structure as defined in claim 34, wherein said distributor is connected to end portion of at least one said rod by an elongated strut.

* * * * *